US011700918B1

(12) United States Patent
Jackson et al.

(10) Patent No.: US 11,700,918 B1
(45) Date of Patent: Jul. 18, 2023

(54) LEG RESTRAINT

(71) Applicant: Security Safety Products (SSP) LLC, Fort Worth, TX (US)

(72) Inventors: Roger Martin Jackson, Fort Worth, TX (US); Matthew Robert Jackson, Fort Worth, TX (US)

(73) Assignee: Security Safety Products (SSP) LLC, Fort Worth, TX (US)

( * ) Notice: Subject to any disclaimer, the term of this patent is extended or adjusted under 35 U.S.C. 154(b) by 0 days.

(21) Appl. No.: 17/681,110

(22) Filed: Feb. 25, 2022

(51) Int. Cl.
*A44B 11/28* (2006.01)

(52) U.S. Cl.
CPC ..... *A44B 11/28* (2013.01)

(58) Field of Classification Search
CPC .. A44B 11/28; Y10T 24/2708; Y10T 24/4764
See application file for complete search history.

(56) References Cited

U.S. PATENT DOCUMENTS 3,000,384 A * 9/1961 Piers, Jr. ..... A45D 8/34 132/273
3,372,438 A * 3/1968 Rinecker ..... A44B 18/00 224/901.4
3,426,363 A * 2/1969 Girard ..... B29C 66/83413 D2/633
3,535,718 A 10/1970 Murcott
3,535,719 A 10/1970 Murcott
3,812,852 A 5/1974 Konvalin
4,204,534 A 5/1980 Leary
4,414,969 A 11/1983 Heyman
4,728,553 A 3/1988 Daniels
4,784,889 A 11/1988 Daniels
4,832,053 A 5/1989 McCarthy
5,261,728 A 11/1993 Carmichael
5,345,947 A 9/1994 Fisher
5,526,824 A 6/1996 McCallister
5,598,812 A 2/1997 Graham et al.
5,603,591 A * 2/1997 McLellan ..... B60P 7/0823 410/97
5,947,062 A 9/1999 Hoffman et al.
5,957,141 A * 9/1999 Elkins ..... A44B 18/00 132/273
6,901,932 B2 6/2005 Chapman
2002/0092531 A1 7/2002 Chapman
2004/0144388 A1 7/2004 Hall et al.
2015/0216713 A1 8/2015 Mabry

* cited by examiner

*Primary Examiner* — Robert Sandy
(74) *Attorney, Agent, or Firm* — D. Tiller Law PLLC; Don Tiller

(57) ABSTRACT

A leg restraint includes a buckle portion in the form of a buckle frame attached to a strap portion. The strap portion includes a section of a loop fabric of a hook-and-loop fastener and a section of a hook fabric of the hook-and-loop fastener. The buckle portion is pliable and resilient and configured to accept the strap within the loop of the buckle frame. The strap is configured to be fed through the buckle frame and looped back on itself to allow the loop portion of the strap to contact the hook portion of the strap, thereby fastening the two strap portions together through the engagement of the hook-and-loop fastener. The strap may have the hook and loop fabric exposed on both faces of the strap such that the strap may be looped back in either direction for fastening.

7 Claims, 3 Drawing Sheets

LEG RESTRAINT

BACKGROUND AND SUMMARY

This invention pertains generally to human restraints. More specifically, the invention is directed to a leg restraint having features to ease use by the detainer and to increase comfort and safety for the detainee.

A security leg restraint ("SLR") according to an aspect of the invention may assist police officers in the control and safety of persons that are resisting arrest. After the person is handcuffed if he continues to resist arrest officers usually place the person on the ground facedown. The officers then apply their body weight on the person's body or head to accomplish control of the person until he is transported to the hospital or jail. Persons have died of asphyxiation from this restraint technique. Use of the SLR can serve to alleviate this issue.

The SLR includes a buckle/strap utilizing hook-and-loop fastening material. The strap can be wrapped around a detainee's ankles binding the ankles together. The strap is fed around the person's ankles, through the buckle frame, then back on itself where contact of a hook surface to a loop surface fastens the strap in place. This immobilizes the detainee's legs. After the SLR is deployed the detainee can be placed in a sitting position or even a standing position for his safety without significant risk of the detainee's flight or fight.

The SLR may also, for example, be used in field interviews. When an officer is conducting a field interview with a person it often becomes evident that an arrest must be affected. A person acting compliant may begin to resist arrest by fighting or running from the officer once he realizes he is being arrested. This action puts the person and the officer in a potentially dangerous situation. To prevent this scenario from happening, the SLR can be wrapped around the person's legs above his knees at the beginning of the interview. The immobilization of the person's legs can reduce the person's desire to resist arrest. Further, if the person attempts to resist arrest the officer can more easily place him on the ground and handcuff him than if the legs were not restrained. At this point, the officer may then re-deploy the SLR to the ankles if necessary or desired.

The SLR may also, for example, be used when the suspect is being arrested has been handcuffed and ankle secured with an SLR. When it becomes necessary to stand the suspect up and have him placed in a vehicle a second SLR can help with this process. A second SLR can be placed above the suspect's knees and the SLR securing the ankles can be removed. At this point the suspect can shuffle his feet and proceed to the police vehicle. The SLR around the suspect's knees allows him to better maintain his balance while walking to the police vehicle but at the same time serves as a leg restraint.

The unique design of the restraint eliminates any exposed metal or sharp edges to ensure there will be no discomfort to the person being detained. The restraint is made to be carried on the officer's utility belt which ensures it is instantly available when needed. And the restraint can be completely ambidextrous, with the strap having a two-sided loop portion and a two-sided hook portion. The two-sided nature of the restraint eliminates the possibility that the restraint may be deployed in the wrong orientation, which improper deployment would complicate the arrest and further endanger both the arresting officer and the person being arrested. The hook portion of the strap is covered with detachable cover tabs that prevent the strap from becoming entangled or inadvertently fastened.

In one exemplary implementation of the invention, a leg restraint includes a buckle-frame and a strap. The buckle-frame is constructed to be flexible and resilient. The flexibility of the buckle-frame enables the frame to flex when pressed against, e.g., a leg. In use, this flexibility significantly decreases the discomfort and potential harm to the person on which the restraint is deployed. The resilience of the buckle-frame enables the frame to substantially return to is original shape after being deformed by the person's body when the restraint is deployed. For example, the buckle-frame may include a rigid top piece (such as a fiberglass or metal rod) and two elastic side pieces (such a rubber rods or plastic tubes) disposed within, and held together in the form of the frame by, a pliable shell (such as nylon webbing). The pliable shell is attached to the strap.

The strap is constructed to include hook-and-loop fastening material such that one portion of the strap is configured with hooks to engage a different portion of the strap that is configured with loops. This engagement enables a selective fastening. For example, on a strap that is about 40 inches long, the bottom 10 inches or so of the strap (the end of the strap that is not connected to the buckle-frame) may be configured with hook material and most of the remaining strap is configured with loop material. In use, the bottom end of the strap may be fed through the buckle-frame, and the strap is then folded back on itself so that the hook portion of the strap is engaged with the loop portion of the strap to hold the strap in place. To ease use of the restraint, the strap may be configured with hook and loop material on both its front and back faces. This enables the strap to be folded back on itself in either direction. Another feature that may be included to ease use are detachable covers for the hook or loop portions to keep the strap from inadvertently engaging itself. For example, a cover may comprise a smooth material (not hook or loop material) with one or two relatively small loop areas that may be used to engage the hook portion of the strap to hold the smooth material in place over the hook portion, covering the hook portion and thereby preventing it from engaging the loop portion of the strap. This can, e.g., enable the strap to be coiled on itself in storage yet be readily deployed by simply uncoiling and removing the cover.

BRIEF DESCRIPTION OF THE DRAWINGS

These and other features, aspects, and advantages of the present invention will become better understood with reference to the following description, appended claims, and accompanying drawings where:

DETAILED DESCRIPTION

Figure 1:
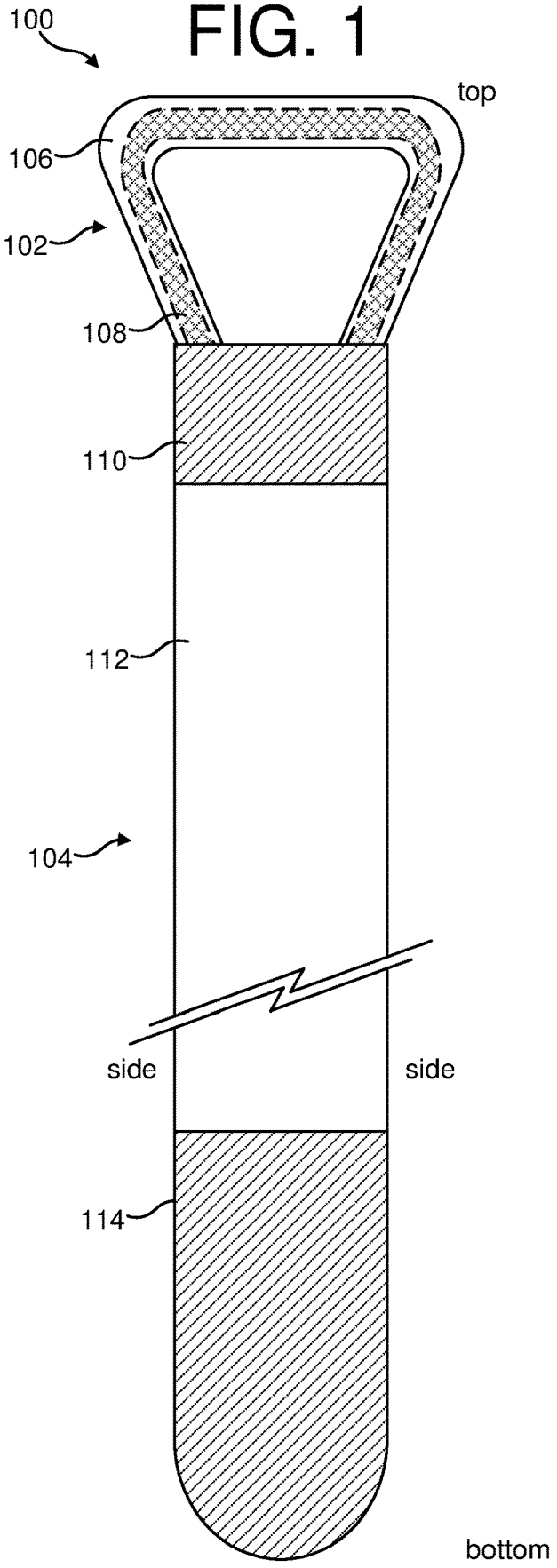
FIG. 1 is a front view of an exemplary leg restraint according to an aspect of the invention.

In the summary above, and in the description below, reference is made to particular features of the invention in the context of exemplary embodiments of the invention. The features are described in the context of the exemplary embodiments to facilitate understanding. But the invention is not limited to the exemplary embodiments. And the features are not limited to the embodiments by which they are described. The invention provides a number of inventive features which can be combined in many ways, and the invention can be embodied in a wide variety of contexts. Unless expressly set forth as an essential feature of the invention, a feature of a particular embodiment should not be read into the claims unless expressly recited in a claim.

Except as explicitly defined otherwise, the words and phrases used herein, including terms used in the claims, carry the same meaning they carry to one of ordinary skill in the art as ordinarily used in the art.

Because one of ordinary skill in the art may best understand the structure of the invention by the function of various structural features of the invention, certain structural features may be explained or claimed with reference to the function of a feature. Unless used in the context of describing or claiming a particular inventive function (e.g., a process), reference to the function of a structural feature refers to the capability of the structural feature, not to an instance of use of the invention.

Except for claims that include language introducing a function with "means for" or "step for," the claims are not recited in so-called means-plus-function or step-plus-function format governed by 35 U.S.C. § 112(f). Claims that include the "means for [function]" language but also recite the structure for performing the function are not means-plus-function claims governed by § 112(f). Claims that include the "step for [function]" language but also recite an act for performing the function are not step-plus-function claims governed by § 112(f).

Except as otherwise stated herein or as is otherwise clear from context, the inventive methods comprising or consisting of more than one step may be carried out without concern for the order of the steps.

The terms "comprising," "comprises," "including," "includes," "having," "haves," and their grammatical equivalents are used herein to mean that other components or steps are optionally present. For example, an article comprising A, B, and C includes an article having only A, B, and C as well as articles having A, B, C, and other components. And a method comprising the steps A, B, and C includes methods having only the steps A, B, and C as well as methods having the steps A, B, C, and other steps.

Terms of degree, such as "substantially," "about," and "roughly" are used herein to denote features that satisfy their technological purpose equivalently to a feature that is "exact." For example, a component A is "substantially" perpendicular to a second component B if A and B are at an angle such as to equivalently satisfy the technological purpose of A being perpendicular to B.

Except as otherwise stated herein, or as is otherwise clear from context, the term "or" is used herein in its inclusive sense. For example, "A or B" means "A or B, or both A and B."

Figure 2:
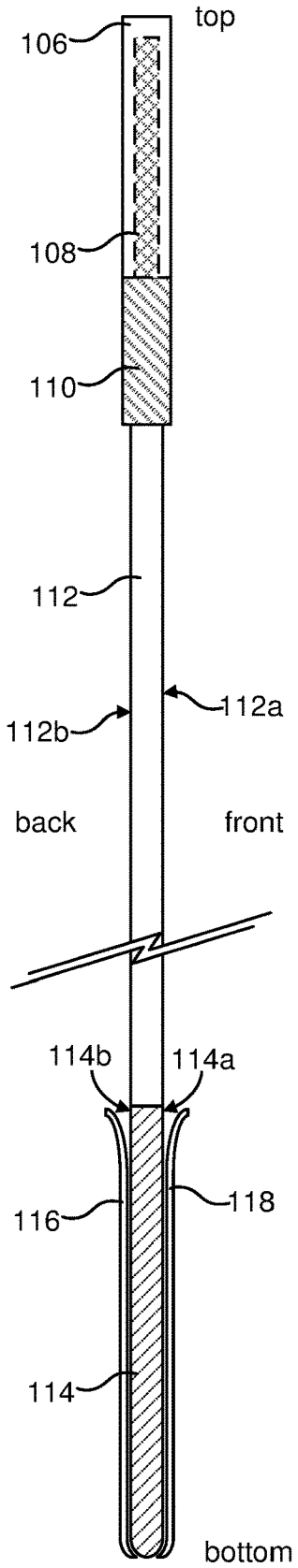
FIG. 2 is a side view of the exemplary restraint, showing hook-portion covers in position to prevent fastening.

An exemplary leg restraint 100 according to an aspect of the invention is depicted in FIGS. 1 and 2. FIG. 1 is a facing view of the restraint 100 and FIG. 2 is a side view of the restraint 100. The restraint 100 includes a buckle-frame portion 102 and a strap portion 104. The buckle-frame portion 102 includes a pliable or malleable outer shell 106 (e.g., nylon beaded hollow webbing) encapsulating a flexible inner support 108 (e.g., a hollow elastomeric tube, a rubber rod, or a coil) shaped as a buckle frame to receive the strap portion 104. (The inner support 108 is shown using dashed-perimeter lines to denote that it is enveloped by the outer shell 106.) Preferably, the combination of outer shell 106 and inner support 108 renders buckle-frame 102 elastic within the domain of use. Thus, while the buckle-frame 102 is capable of deforming under the typical application of force in use (to accommodate the detainee's physical features, for example), it will tend back to its original shape when the force is removed.

The strap 104 includes a transition portion 110, a loop portion 112, and a hook portion 114. The transition portion 110 serves to connect the buckle-frame 102 to the rest of the strap 104. The loop portion 112 includes a front surface 112*a* and a back surface 112*b*. Both loop-portion surfaces 112*a*, 112*b* comprise loop material of a hook-and-loop fabric fastener (e.g., the popular fabric-fastener products marketed under the VELCRO™ brand). The hook portion 114 includes a front surface 114*a* and a back surface 114*b*. Both hook-portion surfaces 114*a*, 114*b* comprise hook material of a hook-and-loop fabric fastener that complements that loop material of the loop portion 112. The front/back surfaces 114*a*/114*b* of the hook portion 114 will selectively fasten to the front/back surfaces 112*a*/112*b* of the loop portion 112 when contacted together. The fastening is selectable in that fastened loop and hook portions 112, 114 may be unfastened by peeling the portions apart.

Figure 3:
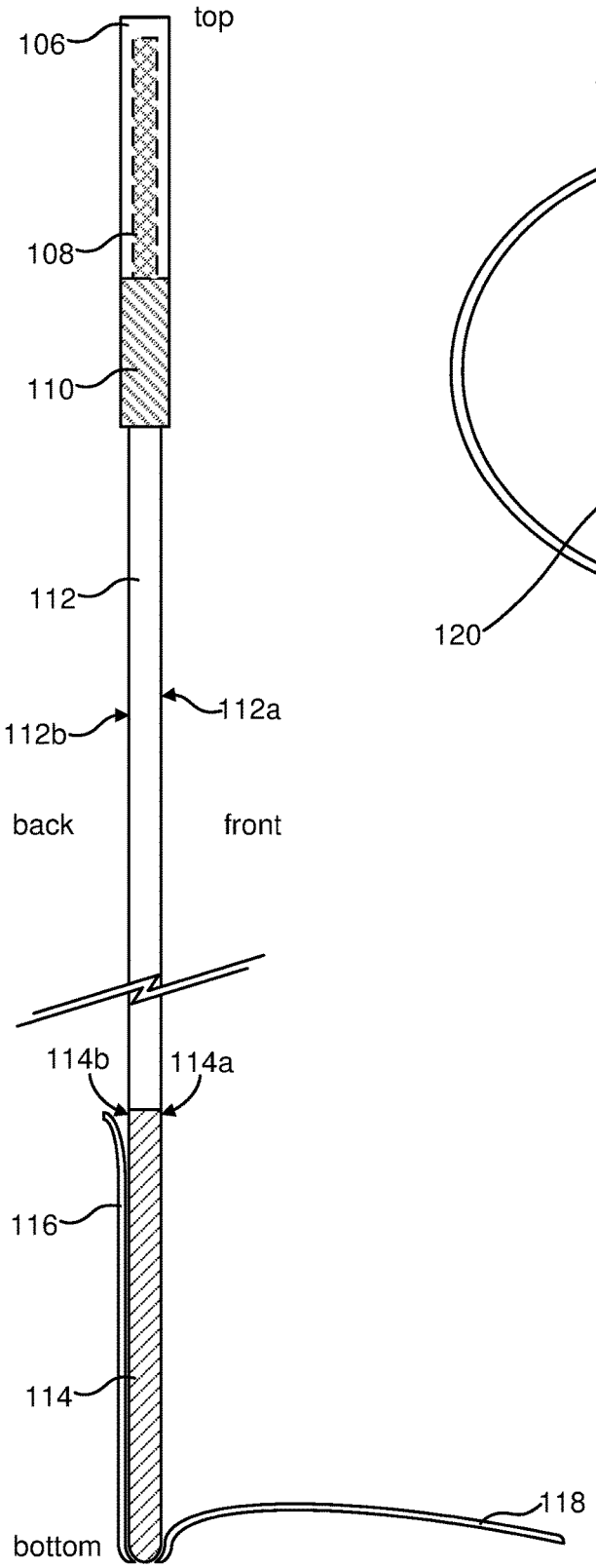
FIG. 3 is a side view of the exemplary restraint, showing one hook-portion cover in position to allow fastening.

Covers 116, 118 may be used to protect the hook-portion surfaces 114*a*, 114*b* and to keep the hook portion 114 from inadvertently fastening to the loop portion 112. The covers 116, 118 comprise loop material to attach to the hook material of the hook-portion surfaces 114*a*, 114*b*. The covers 116, 118 may be attached to the strap 104 apart from the hook-and-loop fastening. For example, the covers 116, 118 may be stitched to the bottom of the hook portion 114. In an exemplary configuration, each cover 116, 118 is constructed from a smooth pliable fabric with an area of loop material on the cover's surface that is facing toward the corresponding hook-portion surface 114*a*, 114*b*. This cover-surface loop area may be a relatively small fraction of the overall area of the hook-portion surface 114*a*, 114*b* covered by the cover. For example, a hook portion 114 may be 11 inches long (top-to-bottom) and 1.75 inches wide (side-to-side) whereas the loop area of the cover surface may be 0.75 inches long (top-to-bottom) and 1.75 inches wide (side-to-side). The cover-surface loop area may be positioned on the portion of the cover 116, 118 that corresponds to the top of the hook portion 114. The top of the covers 116, 118 may extend beyond the top of the hook portion 114 to provide tabs that may be used to pull the covers 116, 118 away from the hook portion 114. Additional areas of loop material along the cover may be used fasten the cover at more points along the length (top-to-bottom) of the hook portion 114. For example, a cover 116, 118 may have loop-material areas corresponding approximately to the top and bottom of the hook portion 144. The area(s) of the cover-surface loop material may be varied to increase or decrease the force required to unfasten the cover 116, 118 from the hook portion 114. FIG. 3 is a side view that illustrates the restraint 100 with one cover 118 unfastened from the hook portion 114.

The restraint 100 is dimensioned sufficient to wrap around a persons legs when looped back on itself through the buckle-frame portion 102 and to provide the strength necessary to detain a human. For example, an exemplary strap portion 104 may be constructed from polyethylene/nylon hook/loop material and be 1.75 inches wide (side-to-side) and 40 inches long (top-to-bottom). The buckle-frame portion 102 may be constructed from a nylon webbing outer shell 106 enveloping a hollow round plastic tube or rubber rod for an inner support 108 and be dimensioned to correspond to the strap 104.

Figure 5:
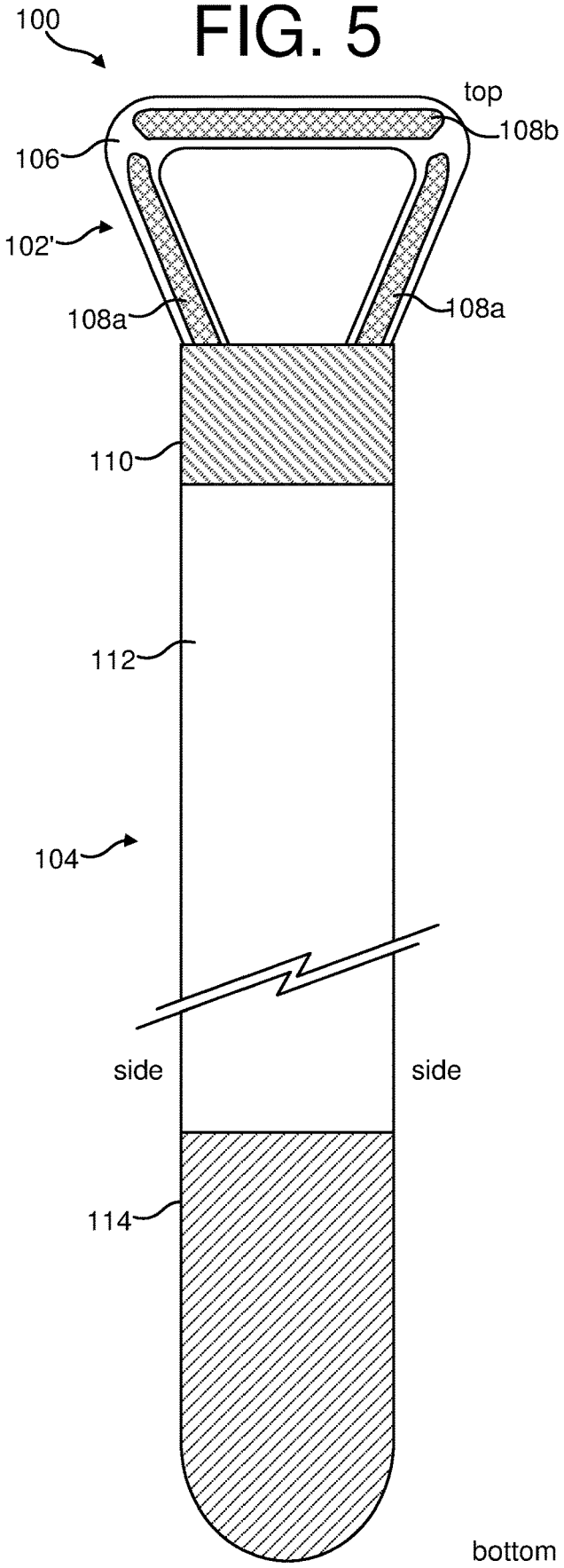
FIG. 5 is a front view of an exemplary leg restraint according to an aspect of the invention.

As depicted in FIG. 5, the buckle frame 102' may be implemented with a three-part inner support 108*a*, 108*b* enveloped by an outer shell 106. This support includes flexible side portions 108*a* that may each be, e.g., plastic tubes or rubber rods. And the three-part support includes a rigid top portion 108*b* that may be, e.g., a solid fiberglass or metal rod. The components of the three-part inner support 108*a*, 108*b* may be connected to each other to form a continuous component comprising multiple materials. The rigid-top buckle-frame 102' maintains a flexibility and resilience top-to-bottom.

In use, the restraint 100 may be, e.g., coiled on an officer's utility belt (e.g., in a pouch) when not deployed. To deploy the restraint 100, the officer would: uncoil the restraint 100; place the strap 104 around the detainee's legs; feed the strap 104 through the buckle frame 102; remove one of the covers 116, 118 from the hook portion 114; loop the strap 104 back on itself to tighten the strap around the legs thereby binding the legs together; and fasten the hook portion 114 to the loop portion 112 to secure the restraint 100 in place, with the strap 104 tight around the detainee's legs.

Figure 4:
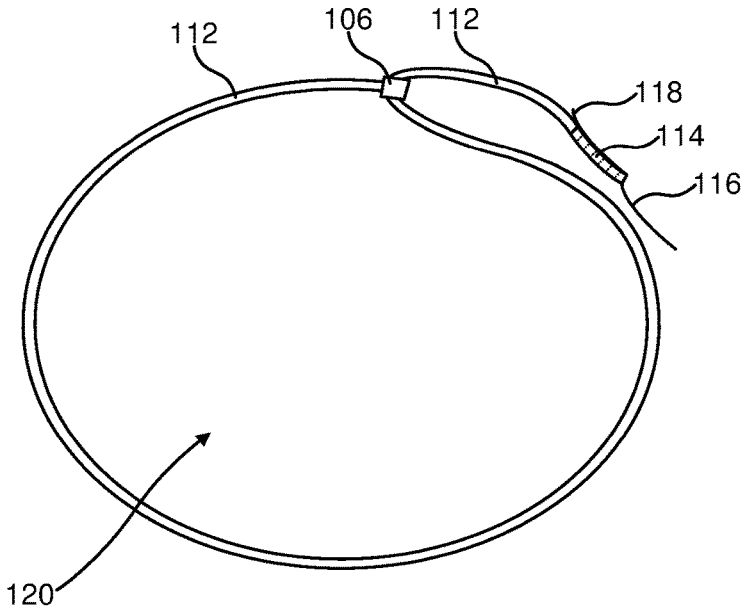
FIG. 4 is a side view of the exemplary restraint, showing the strap fed through the buckle frame and looped back on itself.

FIG. 4 is a side view illustrating how the strap 104 is fed through the buckle portion 102 and looped back on itself in use. In use, the detainee's leg's would be within the opening 120 defined by the looped-back restraint and the opening 120 would be tightened around the legs by pulling the strap 104 further through the buckler portion 102.

While the foregoing description is directed to the preferred embodiments of the invention, other and further embodiments of the invention will be apparent to those skilled in the art and may be made without departing from the basic scope of the invention. And features described with reference to one embodiment may be combined with other embodiments, even if not explicitly stated above, without departing from the scope of the invention. The scope of the invention is defined by the claims which follow.

The invention claimed is:

1. A leg restraint comprising:

(c) a buckle-frame comprising a flexible and resilient assembly; and (d) a strap having a first end and a second end, the strap comprising:

(i) a loop portion comprising a loop fabric of a hook-and-loop fastener, the loop fabric comprising a loop;

(ii) a hook portion comprising a hook fabric of a hook-and-loop fastener, the hook fabric comprising a hook, wherein the hook of the hook fabric is configured to engage to the loop of the loop fabric; and (c) wherein the buckle-frame is attached to the first end of the strap; and (d) wherein the buckle-frame includes:

(i) a pliable outer shell, and (ii) an elastic inner support disposed within the pliable outer shell.

2. The leg restraint of claim 1 wherein the loop portion is disposed at the first end of the strap portion and the hook portion is disposed at the second end of the strap portion.

3. The leg restraint of claim 1 further comprising a rigid inner support disposed within the pliable outer shell, wherein the elastic inner support comprises two elastic portions extending from the strap and the rigid inner support spans the space between the ends of the elastic inner portions that are distal from the strap.

4. The leg restraint of claim 3 wherein each of the elastic portions includes at least one of the group consisting of a plastic tube, a rubber rod, and a coil.

5. A leg restraint comprising:

(a) a buckle-frame comprising a flexible and resilient assembly; and (b) a strap having a first end and a second end, the strap comprising:

(ii) a loop portion comprising a loop fabric of a hook-and-loop fastener, the loop fabric comprising a loop;

(ii) a hook portion comprising a hook fabric of a hook-and-loop fastener, the hook fabric comprising a hook, wherein the hook of the hook fabric is configured to engage to the loop of the loop fabric; and (c) wherein the buckle-frame is attached to the first end of the strap;

(d) wherein the loop portion has a front face and a back face and the loop fabric is exposed on both the front and back faces of the loop portion; and (e) wherein the hook portion has a front face and a back face and the hook fabric is exposed on both the front and back faces of the hook portion.

6. The leg restraint of claim 5, the strap further comprising:

(b) a front-face cover comprising a material that is selectively positionable and configured to attach to and cover the front face of hook portion; and (c) a back-face cover comprising a material that is selectively positionable and configured to attach to and cover the back face of the hook portion.

7. A leg restraint comprising:

(a) a buckle-frame comprising a flexible and resilient assembly; and (b) a strap having a first end and a second end, the strap comprising:

(ii) a loop portion comprising a loop fabric of a hook-and-loop fastener, the loop fabric comprising a loop;

(iii) a hook portion comprising a hook fabric of a hook-and-loop fastener, the hook fabric comprising a hook, wherein the hook of the hook fabric is configured to engage to the loop of the loop fabric; and (c) wherein the buckle-frame is attached to the first end of the strap; and (d) wherein the strap further includes a cover comprising a material that is selectively positionable and configured to attach to and cover the hook portion.

* * * * *